US009340215B2

(12) United States Patent
Masuda et al.

(10) Patent No.: US 9,340,215 B2
(45) Date of Patent: May 17, 2016

(54) DOOR OPENING AND CLOSING APPARATUS

(71) Applicant: NABTESCO CORPORATION, Tokyo (JP)

(72) Inventors: Takeshi Masuda, Hyogo (JP); Shinji Ueda, Hyogo (JP)

(73) Assignee: NABTESCO CORPORATION, Tokyo (JP)

( * ) Notice: Subject to any disclaimer, the term of this patent is extended or adjusted under 35 U.S.C. 154(b) by 0 days.

(21) Appl. No.: 14/300,579

(22) Filed: Jun. 10, 2014

(65) Prior Publication Data

US 2014/0366449 A1 Dec. 18, 2014

(30) Foreign Application Priority Data

Jun. 13, 2013 (JP) ..... 2013-124507

(51) Int. Cl.

| | |
|---|---|
| ***E05C 7/06*** | (2006.01) |
| ***B61D 19/00*** | (2006.01) |
| ***E05B 65/08*** | (2006.01) |
| ***E05B 83/40*** | (2014.01) |
| ***E05B 83/42*** | (2014.01) |
| ***E05B 85/24*** | (2014.01) |
| ***E05B 85/26*** | (2014.01) |
| ***E05B 15/00*** | (2006.01) |
| *E05F 15/635* | (2015.01) |

(Continued)

(52) U.S. Cl.

CPC ..... *B61D 19/007* (2013.01); *B61D 19/00* (2013.01); *E05B 15/0086* (2013.01); *E05B 65/0847* (2013.01); *E05B 83/40* (2013.01); *E05B 83/42* (2013.01); *E05B 85/243* (2013.01); *E05B 85/26* (2013.01); *E05B 85/245* (2013.01); *E05B 2047/0022* (2013.01); *E05C 2007/007* (2013.01); *E05F 15/635* (2015.01); *E05Y 2201/218* (2013.01); *E05Y 2900/51* (2013.01)

(58) Field of Classification Search

CPC ..... E05B 65/08; E05B 83/06
USPC ..... 49/116, 118; 292/213, 216, 219, 22, 292/224, 197, 198, 199, 201, 341.15, 292/341.16, DIG. 46
See application file for complete search history.

(56) References Cited

U.S. PATENT DOCUMENTS 5,483,769 A * 1/1996 Zweili ..... 49/118
5,758,453 A * 6/1998 Inage ..... 49/118

(Continued)

FOREIGN PATENT DOCUMENTS

JP 2008-121242 A 5/2008
KR 101034589 * 4/2010

(Continued)

*Primary Examiner* — Jerry Redman
(74) *Attorney, Agent, or Firm* — Studebaker & Brackett PC

(57) ABSTRACT

A door opening and closing apparatus including a lock mechanism that is configured to hold the door in a fully closed state, and that has an engaging member which engages with a lock member provided in the door when in the fully closed state. A link mechanism having a plurality of link members is configured to be able to undergo deformation into a linear state and a bent state, and restricts rotation of the engaging member by being brought into the linear state. In the link mechanism, a first face is pressed by a projecting shaft moved by the actuator in order that the link mechanism changes from the linear state to the bent state, and a second face is pressed by the projecting shaft in order that the link mechanism changes from the bent state to the linear state.

6 Claims, 8 Drawing Sheets

(51) Int. Cl.
*E05B 47/00* (2006.01)
*E05C 7/00* (2006.01)

(56) References Cited

U.S. PATENT DOCUMENTS 8,661,731 B2 * 3/2014 Lee ..... 49/116
8,978,301 B2 * 3/2015 Ueda et al. ..... 49/122
2002/0194784 A1 * 12/2002 Stojc et al. ..... 49/118
2014/0366449 A1 * 12/2014 Masuda et al. ..... 49/281
2015/0054294 A1 * 2/2015 Uno et al. ..... 292/194

FOREIGN PATENT DOCUMENTS

WO WO 2008056620 A1 * 5/2008
WO WO 2013035592 A1 * 3/2013

* cited by examiner

DOOR OPENING AND CLOSING APPARATUS

CROSS-REFERENCE TO RELATED APPLICATION

This application is based upon and claims the benefit of priority from Japanese patent application No. 2013-124507, the disclosure of which is herein incorporated by reference in its entirety.

BACKGROUND OF THE INVENTION

1. Field of the Invention

The present invention relates to a door opening and closing apparatus that opens and closes a sliding door of a vehicle such as a railway vehicle.

2. Description of Related Art

Conventionally, a door opening and closing apparatus is known that can perform both opening/closing and locking a door with a single motor, using a planetary gear (e.g., JP2008-121242 A). This door opening and closing apparatus includes a lock mechanism that mechanically restricts movement of the door in an opening direction such that the door in a fully closed state is not brought into an opened state by error. The door can thereby be prevented from moving in the opening direction even if a motor enters a free state due to a malfunction or the like, when the door is in the fully closed state.

In the lock mechanism illustrated in FIG. 11 in JP2008-121242 A, as disclosed in paragraph 0073 of JP2008-121242 A, a connecting pin (projecting shaft) fixed to a bottom face portion of a lock slider moves together with the lock slider in a locking direction and an unlocking direction. This projecting shaft is in a state where portions thereof on the locking direction side and the unlocking direction side are sandwiched by a pair of projecting portions formed at a center link in a link mechanism. In this state, the center link rotates as a result of the projecting shaft moving in the locking direction and the unlocking direction, and therefore the lock mechanism is switched between a locked state and an unlocked state.

SUMMARY OF THE INVENTION

Incidentally, in the lock mechanism disclosed in JP2008-121242 A, since the projecting shaft is in a state of being sandwiched by the pair of projecting portions, it is required that the projecting shaft and the pair of projecting portions have relatively high position accuracy and assembly accuracy when the lock mechanism is assembled.

The present invention is for solving the above-described problem, and an object of the present invention is to provide a door opening and closing apparatus including a lock mechanism whose required position accuracy and assembly accuracy are not as high as those in the conventional technique.

(1) To solve the above-described problem, a door opening and closing apparatus according to an aspect of the present invention is a door opening and closing apparatus for opening and closing a door, including: an actuator that moves the door in an opening direction and a closing direction; and a lock mechanism that holds the door in a fully closed state, and has an engaging member which engages with a lock member provided in the door when in the fully closed state, and a link mechanism which has a plurality of link members, is configured to be able to undergo deformation into a linear state and a bent state, and restricts rotation of the engaging member by being brought into the linear state, wherein the link mechanism has a first face that is formed in one of the link members and is pressed by a projecting shaft moved by the actuator in order that the link mechanism changes from the linear state to the bent state, and a second face that is formed in one of the link members and is pressed by the projecting shaft in order that the link mechanism changes from the bent state to the linear state, and the first face and the second face are provided so as to have a positional relationship in which the first face and the second face intersect each other.

With this configuration, when the door is in the fully closed state, rotation of the engaging member that engages with the lock member provided in the door is restricted by the link mechanism in the linear state. Thus, the door is held in the fully closed state. In this state, as a result of the first face of the link mechanism being pressed by the projecting shaft, the link mechanism changes from the linear state to the bent state, and the lock mechanism is brought into the unlocked state. Furthermore, in this state (state where the link mechanism is in the bent state), as a result of the second face of the link mechanism being pressed by the projecting shaft, the link mechanism changes from the bent state to the linear state, and the lock mechanism is brought into the locked state.

Furthermore, the space between the first face and the second face can be widened by providing, as in this configuration, the first face and the second face that are pressed by the projecting shaft, so as to have a positional relationship in which the first face and the second face intersect each other. Thus, when the lock mechanism is assembled, the projecting shaft can be disposed between the first face and the second face with relative ease.

Accordingly, with this configuration, it is possible to provide a door opening and closing apparatus including a lock mechanism whose required assembly accuracy and position accuracy are not as high as those in the conventional technique.

(2) Preferably, the second face is a face that is aligned with a moving direction of the projecting shaft when the link mechanism is in the linear state.

With this configuration, since the projecting shaft moves along the second face of the link mechanism in the linear state, the link mechanism can be reliably changed from the bent state to the linear state even if the moving amount of the projecting shaft varies. For this reason, the required assembly accuracy and position accuracy are not as high as those in the conventional technique, and therefore the workability in assembly can be further improved.

(3) More preferably, the engaging member has an engaging portion in which an opening portion is formed, an end portion of the link mechanism being inserted into the opening portion when the engaging member is rotated in a predetermined direction by the lock member moving in the closing direction, the link members include a first link member having an end portion that serves as the end portion of the link mechanism and is inserted into the opening portion, and a second link member that is connected to the first link member and is provided rotatably, and a rotation restricting member that restricts rotation of the second link member is further provided.

With this configuration, since the position of the second link member is reliably fixed by the projecting shaft and the rotation restricting member, the linear state or the bent state of the link mechanism can be maintained even if the connection between the first link member and the second link member is more or less loose. Thus, the required assembly accuracy and position accuracy of the link mechanism are not as high as those in the conventional technique, and therefore the workability in assembly can be still further improved.

(4) More preferably, a withdrawal preventing portion that prevents the end portion of the link mechanism engaging with the opening portion from withdrawing in a case where a force in the opening direction is exerted on the door in the fully closed state is formed in the opening portion.

With this configuration, it is possible to prevent, using the withdrawal preventing portion, the end portion of the link mechanism that is inserted into the opening portion of the engaging member from withdrawing from the opening portion due to looseness. Thus, the link mechanism can be held in the linear state, while the required assembly accuracy of the link mechanism is not as high as that in the conventional technique.

(5) More preferably, the withdrawal preventing portion has a bulging portion that is formed in a part of the opening portion on a side opposite to a side in the predetermined direction, and that bulges from the part toward the opening portion.

With this configuration, it is possible to appropriately prevent, using the bulging portion, the end portion of the link mechanism that is inserted into the opening portion of the engaging member from withdrawing from the opening portion.

(6) Preferably, the lock mechanism includes: a plurality of the engaging members each being rotated in a predetermined direction by the lock member moving in the closing direction; and a plurality of biasing portions that are provided in association with the engaging members in one-to-one correspondence and bias the respective engaging members in a direction opposite to the predetermined direction.

For example, in the case where only one biasing portion is provided in the lock mechanism, if this biasing portion is broken or withdraws, the engaging member cannot be appropriately rotated in a direction (i.e., in an unlocking direction) opposite to the predetermined direction. In contrast, with the above-described configuration, even if some of the plurality of biasing portions are broken or withdraw, the engaging member can be appropriately rotated in the unlocking direction by the other biasing portions. That is to say, with this configuration, the lock mechanism can be operated more appropriately.

Note that the above and other objects, features, and advantages of the present invention will become apparent by reading the following description with the attached drawings.

DETAILED DESCRIPTION OF THE INVENTION

Hereinafter, a mode for carrying out the present invention will be described with reference to the drawings. A door opening and closing apparatus 2 according to an embodiment of the present invention is not limited to that in an exemplary mode described in the following embodiment, and can be widely applied to door opening and closing apparatuses for opening and closing sliding doors.

Configuration

Figure 1:
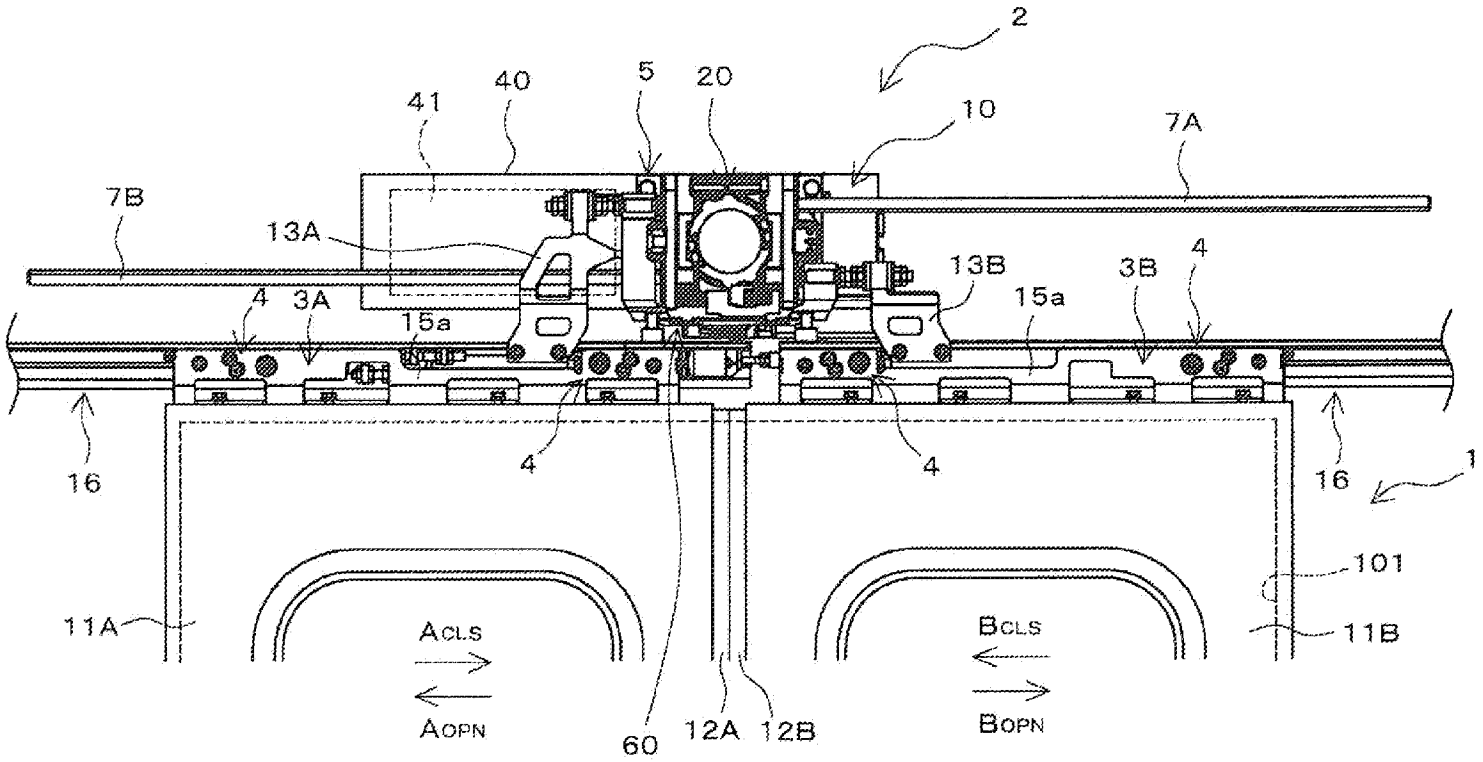
FIG. 1 is a front view showing an embodiment in which a door opening and closing apparatus according to an embodiment of the present invention is installed on openable/closable doors for a vehicle.
Figure 2:
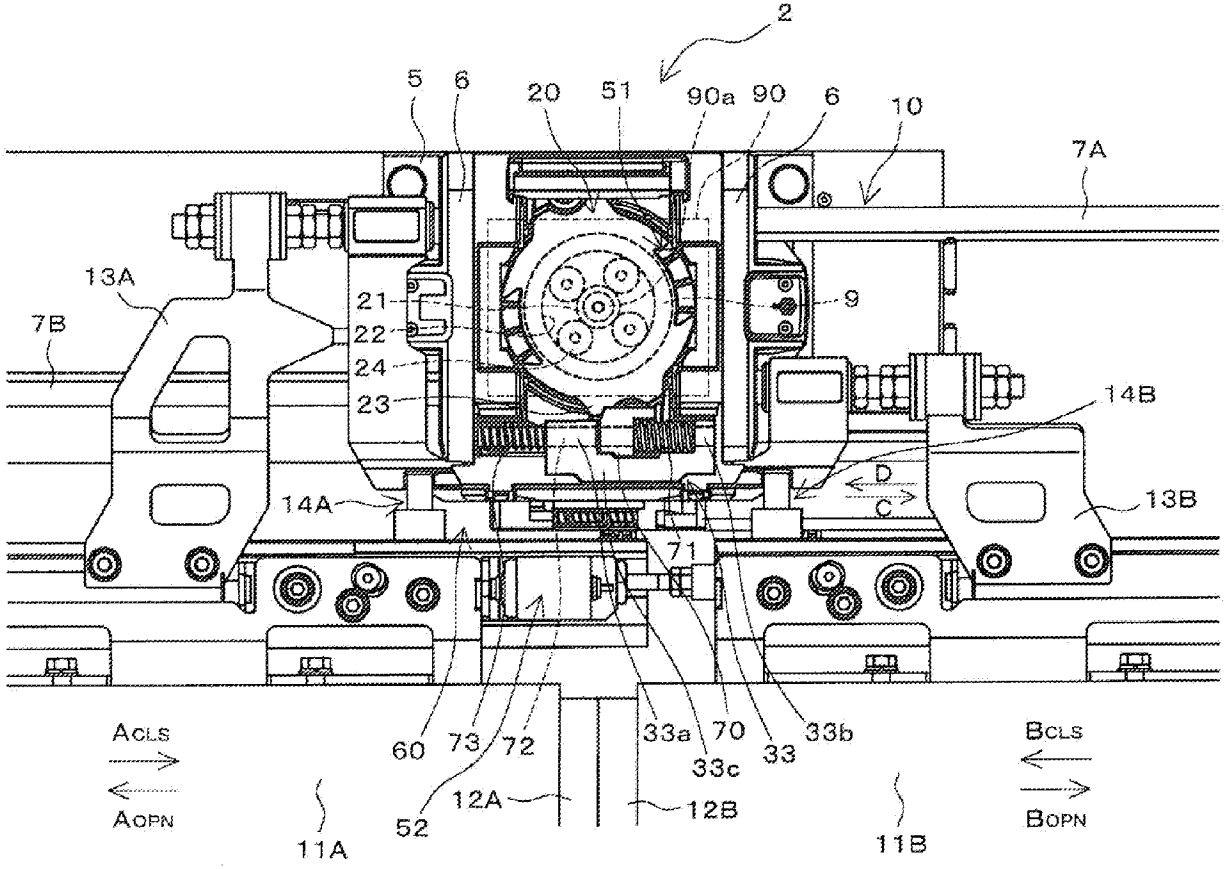
FIG. 2 is a front view showing a main part of a configuration of the door opening and closing apparatus in a locked state.
Figure 3:
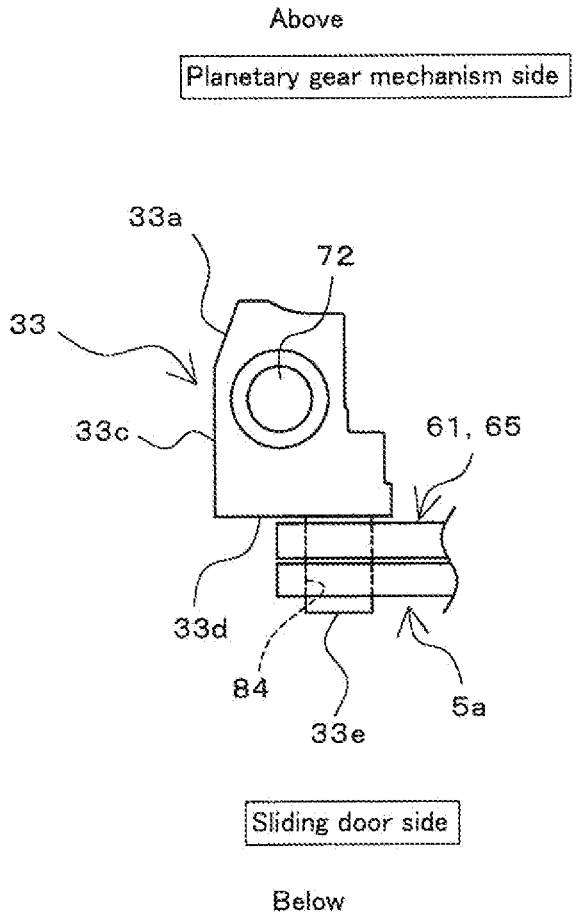
FIG. 3 is a schematic view of a lock slider and a part of a lock mechanism when the door opening and closing apparatus is viewed from a side thereof.
Figure 4:
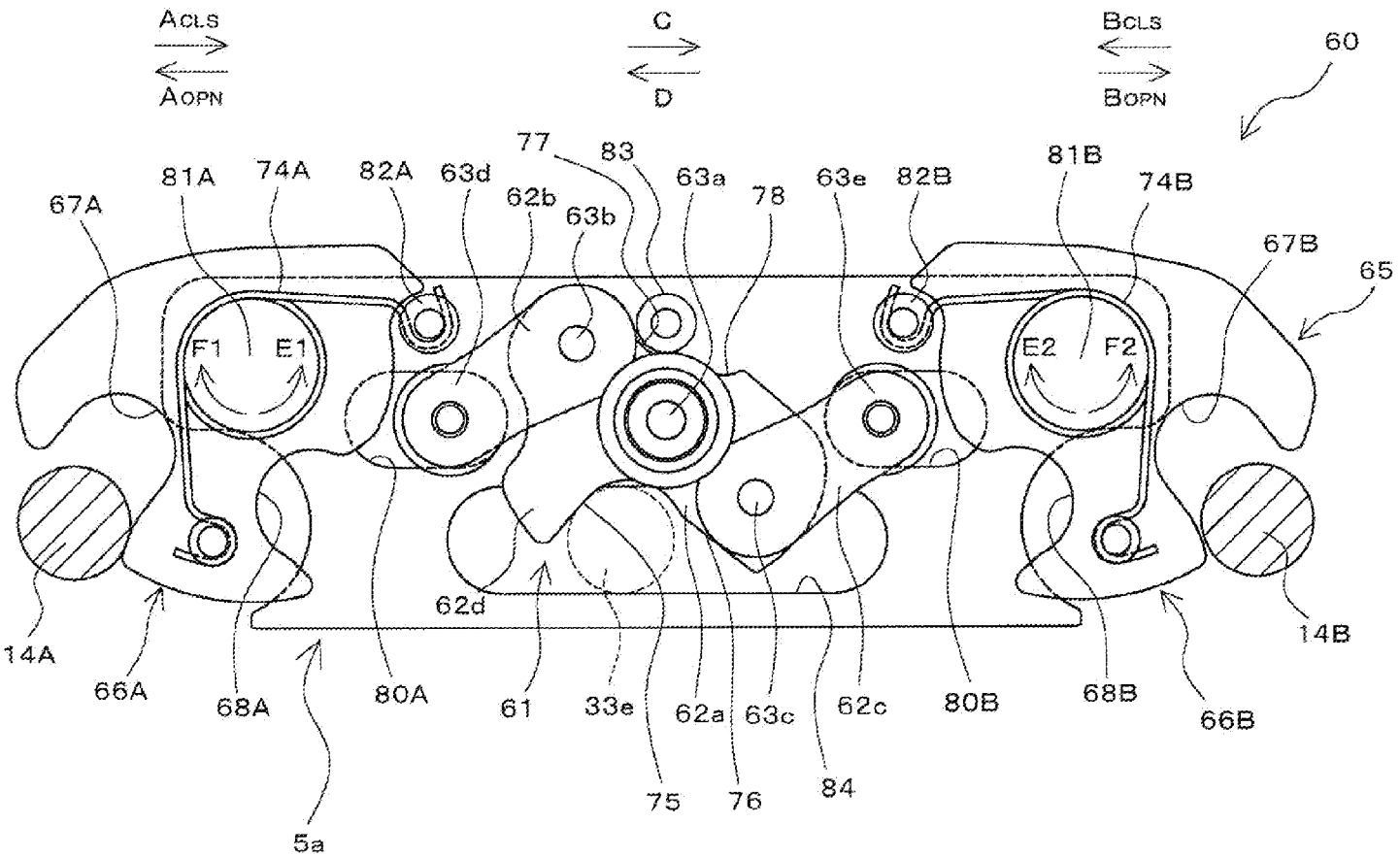
FIG. 4 is a schematic view showing a state of the lock mechanism as viewed from the lock slider side, and shows the lock mechanism in an unlocked state.
Figure 5:
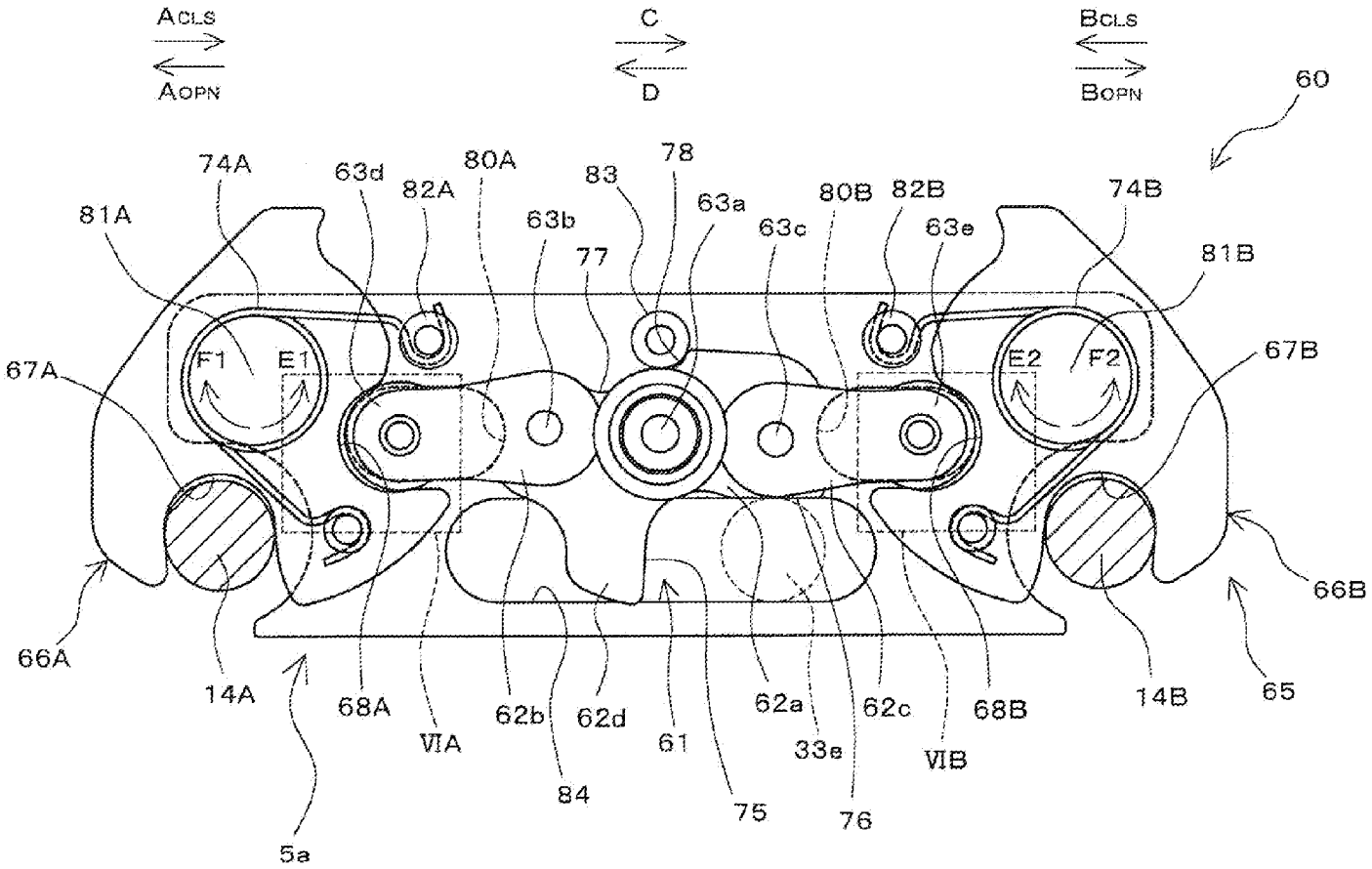
FIG. 5 is a schematic view showing a state of the lock mechanism as viewed from the lock slider side, and shows the lock mechanism in a locked state.

FIG. 1 is a front view showing an embodiment in which the door opening and closing apparatus is installed on openable/closable doors for a vehicle. FIG. 2 is a front view showing a main part of a configuration of the door opening and closing apparatus. FIG. 3 is a schematic view of a lock slider and a part of a lock mechanism when the door opening and closing apparatus is viewed from a side thereof. FIG. 4 is a schematic view showing a state of the lock mechanism as viewed from the lock slider side (upper side), and shows the lock mechanism in an unlocked state. FIG. 5 is a schematic view showing a state of the lock mechanism as viewed from the lock slider side, and shows the lock mechanism in a locked state.

Openable/closable doors 1 for a vehicle shown in FIG. 1 are configured as doors that can open and close an entrance 101 formed in a side wall of a vehicle such as a railroad vehicle, and include a pair of sliding doors, namely left and right sliding doors 11A and 11B, which are two-panel sliding doors. Door leading ends of the sliding doors 11A and 11B face each other. The door opening and closing apparatus 2 is provided in order to open and close the sliding doors 11A and 11B between the fully opened position and fully closed position, and to lock the sliding doors 11A and 11B when the sliding doors 11A and 11B are at the fully closed position. Note that FIG. 1 shows the sliding doors 11A and 11B at the fully closed position. The openable/closable doors 1 for a vehicle can be opened and closed, and can be automatically locked so as not to open unexpectedly when in the closed state, by the door opening and closing apparatus 2 according to an embodiment of the present invention. The door opening and closing apparatus 2 is installed on the entrance 101.

Referring to FIGS. 1 and 2, the door opening and closing apparatus 2 includes an electric motor (actuator) 90, a rack-and-pinion mechanism (moving mechanism) 10, a planetary gear mechanism 20, a lock mechanism 60, and a control box 40 within which a control unit 41 for controlling the electric motor 90 is disposed. In the door opening and closing apparatus 2, the electric motor 90 is driven in accordance with various commands from the control unit 41 so as to open and close the doors, lock the doors, unlock the doors, and so forth.

The sliding doors 11A and 11B that are opened and closed by the door opening and closing apparatus 2 will be described first with reference to FIGS. 1 and 2. The sliding doors 11A and 11B are provided so as to be able to move back and forth along a guide rail 16 that is installed horizontally above the entrance 101. More specifically, hangers 3A and 3B are fixed to the upper edges of the sliding doors 11A and 11B, respectively, and door rollers 4 are rotatably supported by the hangers 3A and 3B. These door rollers 4 are configured to be able to roll on the guide rail 16.

A plate-like base 5 is fixed above the entrance 101 to the side wall of the vehicle. Two racks 7A and 7B are supported by a rack support 6 fixed to the base 5. The racks 7A and 7B are disposed with their longitudinal direction aligned with the horizontal direction, which is parallel with the guide rail 16, and are supported by a slide support portion so as to be able to slide in the longitudinal direction.

The two racks 7A and 7B are disposed parallel with each other with an appropriate interval formed therebetween in the up-down direction, and are disposed such that their teeth portions face each other. A pinion 9 is rotatably disposed so as to simultaneously mesh with both teeth portions of the two racks 7A and 7B. The pinion 9 is disposed above the entrance 101 at the central position in the left-right direction of the entrance 101, so as to be sandwiched from above and below by the two racks 7A and 7B.

Arm members 13A and 13B are installed at corresponding ends of the racks 7A and 7B. The arm members 13A and 13B are fixed to the hangers 3A and 3B via coupling members 15*a* and 15*b*, respectively. That is to say, one end of each of the racks 7A and 7B is connected to the corresponding one of the sliding doors 11A and 11B, via the arm members 13A and 13B. The racks 7A and 7B and the pinion 9 constitute a rack-and-pinion mechanism 10. The two sliding doors 11A and 11B are driven to open and close by the rack-and-pinion mechanism 10. Note that the rack-and-pinion mechanism 10 also plays a role of realizing symmetrical opening and closing movements of the sliding doors 11A and 11B by connecting the left and right sliding doors 11A and 11B to each other.

The sliding doors 11A and 11B can move along the longitudinal direction of the guide rail 16 in closing directions $A_{CLS}$ and $B_{CLS}$ of approaching each other and in opening directions $A_{OPN}$ and $B_{OPN}$ of moving away from each other, respectively. Note that the opening direction $A_{OPN}$ of the sliding door 11A is opposite to the opening direction $B_{OPN}$ of the sliding door 11B. The closing direction $A_{CLS}$ of the sliding door 11A is opposite to the closing direction $B_{CLS}$ of the sliding door 11B.

Elastic members 12A and 12B are disposed at the door leading ends of the sliding doors 11A and 11B, that is, the end portions of the sliding doors 11A and 11B in the closing directions $A_{CLS}$ and $B_{CLS}$, respectively. When the sliding doors 11A and 11B are located at the fully closed position shown in FIG. 1, the gap between the sliding doors 11A and 11B is closed up as a result of the elastic members 12A and 12B coming into contact with each other. The elastic members 12A and 12B extend, at the door leading ends of the sliding doors 11A and 11B, from the upper ends to the lower ends of the sliding doors 11A and 11B. By coming into contact with each other, the elastic members 12A and 12B work so as to close the entrance 101 of the vehicle where the sliding doors 11A and 11B are disposed.

As shown in FIG. 2, lock pins (lock members) 14A and 14B that extend vertically upward are fixed to the hangers 3A and 3B, respectively. With this configuration, the lock pins 14A and 14B can move integrally with the sliding doors 11A and 11B. When the sliding doors 11A and 11B are at the fully closed position, the lock pins 14A and 14B are constrained by the later-described lock mechanism 60, and movement of the pair of sliding doors 11A and 11B, in particular, the movement thereof in the opening directions $A_{OPN}$ and $B_{OPN}$ is thereby locked.

The planetary gear mechanism 20 is supported by the base 5. The planetary gear mechanism 20 is provided in order to selectively distribute the output of the electric motor 90 to either the rack-and-pinion mechanism 10 or the lock mechanism 60. The planetary gear mechanism 20 has a sun gear 21, an internal gear 22, a carrier 23, and planetary gears 24.

The sun gear 21 is rotatably supported by a bearing or the like (not shown). A plurality of planetary gears 24 are disposed on the outer circumference of the sun gear 21, and are configured to mesh with the sun gear 21 and to be able to rotate and revolve. The internal gear 22 has internal teeth that mesh with the planetary gears 24. The carrier 23 supports the planetary gears 24 so as to be able to rotate around the sun gear 21. The sun gear 21, the internal gear 22, and the carrier 23 are disposed on the same axis as that of the pinion 9, and are disposed so as to be capable of relative rotation with respect to one another.

An output shaft 90*a* of the electric motor 90, which is of the direct-drive type and is capable of forward and reverse rotation, is connected to the sun gear 21, and the output of the electric motor 90 is input to the sun gear 21. Note that the sun gear 21 and the output shaft 90*a* may be connected via an appropriate deceleration mechanism. The internal gear 22 is connected to the pinion 9 in the rack-and-pinion mechanism 10, using a bolt or the like (not shown), and can transmit the output of the electric motor 90 to the rack-and-pinion mechanism 10. Thus, the rack-and-pinion mechanism 10 can move the sliding doors 11A and 11B in the opening directions $A_{OPN}$ and $B_{OPN}$ and the closing directions $A_{CLS}$ and $B_{CLS}$, respectively, using the output of the electric motor 90.

The carrier 23 is connected to a traction member 70. The traction member 70 is provided in order to draw the lock slider 33 for switching between a locked state and an unlocked state of the sliding doors 11A and 11B. The carrier 23 can transmit the output of the electric motor 90 to a link mechanism 61 in the lock mechanism 60 via the traction member 70, a torque limiter spring 71, and the lock slider 33.

The traction member 70 and the lock slider 33 are installed so as to be able to move back and forth in the left-right direction along a guide shaft 72 that extends parallel with the racks 7A and 7B and is fixed to the rack support 6, and form a switching mechanism for switching between the locked state and the unlocked state. The traction member 70 is coupled to the carrier 23 so as to be able to move in a locking direction C and an unlocking direction D with rotation of the carrier 23. The torque limiter spring 71, such as a coil spring, is arranged between the traction member 70 and the lock slider 33. The torque limiter spring 71 exerts the elastic force on the traction member 70 and the lock slider 33 so as to press the traction member 70 against the lock slider 33. That is to say, the torque limiter spring 71 is disposed so as to suppress relative movement of the traction member 70 with respect to the lock slider 33.

An attachment portion 33*a* and an attachment portion 33*b* are provided at the upper end of the lock slider 33. The attachment portion 33*a* and the attachment portion 33*b* are disposed so as to be spaced apart at a predetermined interval in the locking direction C, and are formed so as to be able to slide with the guide shaft 72. Note that the locking direction C is a direction parallel with the opening directions $A_{OPN}$ and $B_{OPN}$. The unlocking direction D is the direction opposite to the locking direction C.

As shown in FIGS. 2 and 3, the lock slider 33 has a front face portion 33*c* that extends downward from the attachment portion 33*a* and the attachment portion 33*b*, and a bottom face portion 33*d* that is formed from the lower end of the front face portion 33*c* toward the paper background direction in FIG. 2. The traction member 70 is attached to the guide shaft 72 at a position between the attachment portion 33*a* and the attachment portion 33*b*.

The torque limiter spring 71 attached to the guide shaft 72 is disposed between the traction member 70 and the attachment portion 33*b* located on the leading end side of the lock slider 33 in the locking direction C. The torque limiter spring 71 is attached in a state of being elastically compressed in its axis direction. Thus, the traction member 70 receives the biasing force toward the attachment portion 33*a*, and the traction member 70 is held in a state of being in contact with the attachment portion 33*a*.

A lock spring 73 is installed on the guide shaft 72 so as to bias the attachment portion 33*a* of the lock slider 33 in the locking direction C. The lock spring 73 suppresses the lock slider 33 at a locking position returning to an unlocking position.

A projecting shaft 33*e* that projects downward is provided at the bottom face portion 33*d* of the lock slider 33 (see FIGS. 3, 4, and 5). A first roller (not shown) is rotatably attached to the projecting shaft 33*e*. The first roller is inserted into a guide groove 84 that is formed in a groove shape in a plate member 5*a* provided in the base 5 and extends in the locking direction C. The first roller is thereby displaced along the guide groove 84 in the locking direction C and the unlocking direction D. The first roller enables the projecting shaft 33*e* to be smoothly displaced along the guide groove 84. A second roller (not shown) is also rotatably attached to the projecting shaft 33*e*, and this second roller can come into contact with a first face 75 of a projecting portion 62*d* that is formed at a peripheral portion of a later described link 62*a*, and with a second face 76 that is formed in the link 62*a*. In this configuration, upon the lock slider 33 being displaced in the unlocking direction D, the second roller presses the first face 75 and thereby displaces the position of the link 62*a*, and the orientation (position) of the link mechanism 61 consequently changes from a linear state (state shown in FIG. 5) to a bent state (state shown in FIG. 4). On the other hand, upon the lock slider 33 being displaced in the locking direction C, the second roller presses the second face 76 and thereby changes the position of the link 62*a*, and the orientation (position) of the link mechanism 61 consequently changes from the bent state (state shown in FIG. 4) to the linear state (state shown in FIG. 5).

Note that although an example using the rollers (first roller and second roller) has been given here, there is no limitation thereto, and any other configuration may be employed as long as sliding resistance between the projecting shaft 33*e* and the above-described other portions (guide groove 84, first face 75, and second face 76) can be reduced. For example, bearings or bushings may be used in place of the rollers.

Next, the lock mechanism 60 for locking the sliding doors 11A and 11B at the fully closed position will be described in detail. The lock mechanism 60 is configured to be able to operate using the output of the electric motor 90, and is configured to restrict movement of the sliding doors 11A and 11B respectively in the opening directions $A_{OPN}$ and $B_{OPN}$ when the sliding doors 11A and 11B are at the fully closed position.

The lock mechanism 60 is a mechanism that operates horizontally, and is installed so as to be adjacent to the lower part (on the planetary gear mechanism 20 side) of the bottom face portion 33*d* of the lock slider 33. As shown in FIGS. 4 and 5, the lock mechanism 60 includes the link mechanism 61 and a link holding mechanism 65 that operates horizontally.

The link mechanism 61 is configured to be able to undergo deformation into the bent state (state shown in FIG. 4) and the linear state (state shown in FIG. 5) by undergoing horizontal deformation. The link mechanism 61 is formed by connecting three links 62*a*, 62*b*, and 62*c*. Two links, namely the links 62*b* and 62*c* disposed on respective sides of the center link 62*a* are each provided as a first link member, and the center link 62*a* is provided as a second link member. The center link 62*a* is coupled to a connecting pin 63*a* at the center in the longitudinal direction thereof, and can thereby pivot with respect to the plate member 5*a*. The center link 62*a* is provided with a projecting portion 62*d* that is formed so as to project outward from an outer peripheral portion of the link 62*a*. One end of the link 62*b* is connected to one end of the center link 62*a* via a connecting pin 63*b* so as to be capable of relative rotation. One end of the link 62*c* is connected to the other end of the link 62*a* via a connecting pin 63*c* so as to be capable of relative rotation. The links 62*b* and 62*c* are provided with pins 63*d* and 63*e*, respectively.

The center link 62*a* has the first face 75 and the second face 76. The first face 75 is a face of the projecting portion 62*d* on the link 62*c* side. The first face 75 is a portion that is pressed by the second roller of the projecting shaft 33*e* when the link mechanism 61 changes from the linear state to the bent state, which will be described later in detail. The second face 76 is a portion that is pressed by the second roller of the projecting shaft 33*e* when the link mechanism 61 changes from the bent state to the linear state.

As shown in FIGS. 4 and 5, the first face 75 and the second face 76 are in a positional relationship in which the first and second faces 75 and 76 intersect each other, that is, a positional relationship in which the first and second faces 75 and 76 are not parallel with each other. Note that although the angle between the first face 75 and the second face 76 substantially is the right angle in the present embodiment, there is no limitation thereto, and the angle therebetween may be an acute angle or an obtuse angle. The second face 76 is a face aligned with the locking direction C (i.e., along the moving direction of the projecting shaft 33*e*) when the link mechanism 61 is in the linear state as shown in FIG. 5.

The pins 63*d* and 63*e* are located at the respective end portions of the link mechanism 61. The pins 63*d* and 63*e* are inserted into guide grooves 80A and 80B that are formed in the plate member 5*a* and extend in a direction parallel with the locking direction C. The pins 63*d* and 63*e* are thereby installed so as to be able to move along the guide grooves 80A and 80B. That is to say, the movement of the pins 63*d* and 63*e* is guided respectively by the guide grooves 80A and 80B.

Note that rollers which are inserted into the guide grooves 80A and 80B are rotatably attached to the pins 63*d* and 63*e*. Thus, frictional resistance between the pins 63*d* and 63*e* and the guide grooves 80A and 80B is reduced, and the movement of the pins 63*d* and 63*e* is made smoother. Furthermore, other rollers are also rotatably attached to the pins 63*d* and 63*e*. The other rollers are provided in order to reduce frictional resistance caused due to their relative movement with respect to later-described engaging members 66A and 66B, and to stabilize the locking operation.

A rotation restricting member 83 having a tubular shape is provided near the pin 63*a* in the plate member 5*a*. This rotation restricting member 83 is fitted into a first recess portion 77 formed in the link 62*a* when the link mechanism 61 is in the bent state shown in FIG. 4. The rotation restricting member 83 thereby restricts a further clockwise rotation of the link 62*a* from the state shown in FIG. 4. The link 62*a* in the link mechanism 61 in the bent state is in a state of being sandwiched by the projecting shaft 33*e* and the rotation restricting member 83.

On the other hand, the rotation restricting member 83 is fitted into a second recess portion 78 formed in the link 62*a* when the link mechanism 61 is in the linear state shown in FIG. 5. The rotation restricting member 83 thereby restricts a further counterclockwise rotation of the link 62*a* from the state shown in FIG. 5. The link 62*a* in the link mechanism 61 in the linear state is also in a state of being sandwiched by the projecting shaft 33*e* and the rotation restricting member 83.

In the link mechanism 61 having the above-described configuration, the projecting shaft 33*e* presses the first face 75 of the projecting portion 62*d* of the link 62*a* via the second roller in the direction D, as the lock slider 33 is displaced in the unlocking direction D. The link 62*a* thereby pivots in a clockwise direction in FIG. 5 around the pin 63*a* until the rotation restricting member 83 is fitted into the first recess portion 77 of the link 62*a*, and accordingly the link mechanism 61 changes to the bent state shown in FIG. 4. On the other hand, in the link mechanism 61, the projecting shaft 33*e* presses the second face 76 of the link 62*a* via the second roller in the direction C as the lock slider 33 is displaced in the locking direction C. The link 62*a* thereby pivots in a counterclockwise direction in FIG. 4 around the pin 63*a* until the rotation restricting member 83 is fitted into the second recess portion 78 of the link 62*a*, and accordingly the link mechanism 61 changes to the linear state shown in FIG. 5. Here, the projecting shaft 33*e* slightly moves in the locking direction C even after the second face 76 is brought into a state of being aligned with the moving direction of the projecting shaft 33*e*.

The link holding mechanism 65 includes a pair of engaging members 66A and 66B and a pair of return springs 74A and 74B (biasing portion) that are attached to the engaging members 66A and 66B, respectively. The pair of engaging members 66A and 66B are disposed in the vicinity of respective end portions of the link mechanism 61, so as to be symmetrical in a direction parallel with the locking direction C with respect to the connecting pin 63*a* of the link mechanism 61, and are configured to be able to pivot on a horizontal plane around pivoting shafts 81A and 81B, respectively.

The engaging members 66A and 66B are provided so as to be able to engage respectively with the lock pins 14A and 14B such that movement of the lock pins 14A and 14B in the respective opening directions $A_{OPN}$ and $B_{OPN}$ is restricted. First engaging portions 67A and 67B and second engaging portions 68A and 68B (engaging portion), which are formed in a recess shape, are provided at peripheral portions of the engaging members 66A and 66B, respectively. The first engaging portions 67A and 67B and the second engaging portions 68A and 68B have opening portions that are open outward of the engaging members 66A and 66B, respectively. The engaging members 66A and 66B are supported by the plate member 5*a* via the pivoting shafts 81A and 81B. The engaging members 66A and 66B can rotate around the pivoting shafts 81A and 81B as a result of coming into contact with the lock pins 14A and 14B that are displaced respectively in the opening directions $A_{OPN}$ and $B_{OPN}$ or the closing directions $A_{CLS}$ and $B_{CLS}$. Note that a state where the engaging members 66A and 66B engage with the lock pins 14A and 14B refers to a state where the lock pins 14A and 14B have entered and cannot move out of the inside of the first engaging portions 67A and 67B.

Furthermore, bulging portions 69A and 69B (withdrawal preventing portion) are formed in the engaging members 66A and 66B, respectively. The bulging portions 69A and 69B are formed so as to bulge toward the opening portion sides of the second engaging portions 68A and 68B, near the opening portions of the second engaging portions 68A and 68B.

The return springs 74A and 74B are constituted by torsion springs that bias the engaging members 66A and 66B such that the first engaging portions 67A and 67B of the engaging members 66A and 66B face in the opening directions $A_{OPN}$ and $B_{OPN}$, respectively. That is to say, the return spring 74A biases the engaging member 66A in the direction F1, and the return spring 74B biases the engaging member 66B in the direction F2. The return springs 74A and 74B are respectively attached, on one end side, to ribs 82A and 82B provided in the plate member 5*a*, and are respectively attached, on the other end side, to the engaging members 66A and 66B.

As shown in FIGS. 4 and 5, the first engaging portions 67A and 67B of the engaging members 66A and 66B are formed in a hook shape. In a state where the lock pins 14A and 14B do not engage with the engaging members 66A and 66B, the lock pins 14A and 14B and a part of the first engaging portions 67A and 67B face each other in a direction parallel with the locking direction C.

In a state where the link holding mechanism 65 does not receive an external force, the engaging members 66A and 66B receive a force from the return springs 74A and 74B, and are held in the state shown in FIG. 4. That is to say, the engaging members 66A and 66B are held in a state where the opening portions of the first engaging portions 67A and 67B face respectively in the opening directions $A_{OPN}$ and $B_{OPN}$, and the opening portions of the second engaging portions 68A and 68B face respectively in the closing directions $A_{CLS}$ and $B_{CLS}$.

On the other hand, when the lock pins 14A and 14B move respectively in the closing directions $A_{CLS}$ and $B_{CLS}$ and thereby reach the vicinity of the fully closed position, the lock pins 14A and 14B bias edge portions of the first engaging portions 67A and 67B of the engaging members 66A and 66B, as shown in FIG. 4. The engaging members 66A and 66B thereby pivot around the pivoting shafts 81A and 81B in rotational directions E1 and E2 against the biasing forces of the return springs 74A and 74B, respectively. For this reason, the second engaging portions 68A and 68B approach the link mechanism 61.

In a state where the sliding doors 11A and 11B are in the fully closed position, as shown in FIG. 5, the lock pins 14A and 14B are brought into a state of having entered the inside of the first engaging portions 67A and 67B, and the lock pins 14A and 14B thereby engage respectively with the first engaging portions 67A and 67B. Furthermore, as a result of the end portions of the links 62*b* and 62*c* in the opening directions $A_{OPN}$ and $B_{OPN}$ being brought into a state of having entered the inside of the second engaging portions 68A and 68B, the links 62*b* and 62*c* engage respectively with the second engaging portions 68A and 68B. At this time, the link mechanism 61 is in the linear state.

Figure 6A:
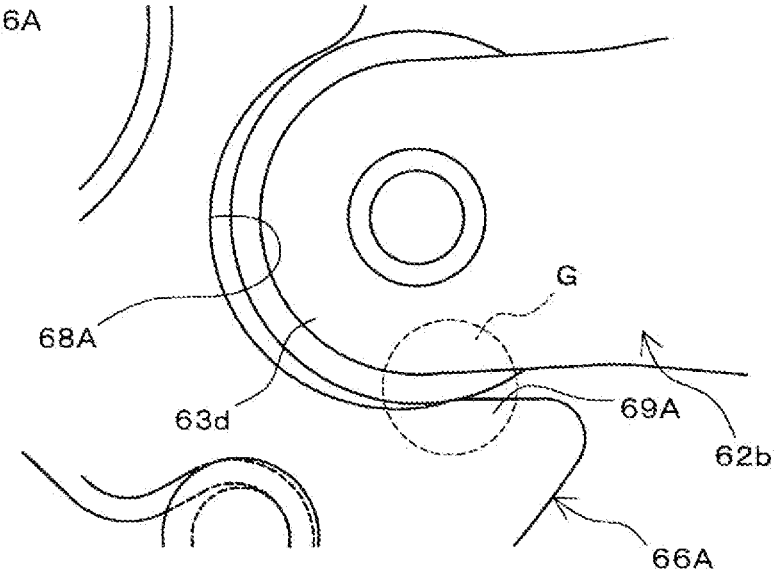
FIG. 6A is an enlarged view of a portion VIA in FIG. 5.
Figure 6B:
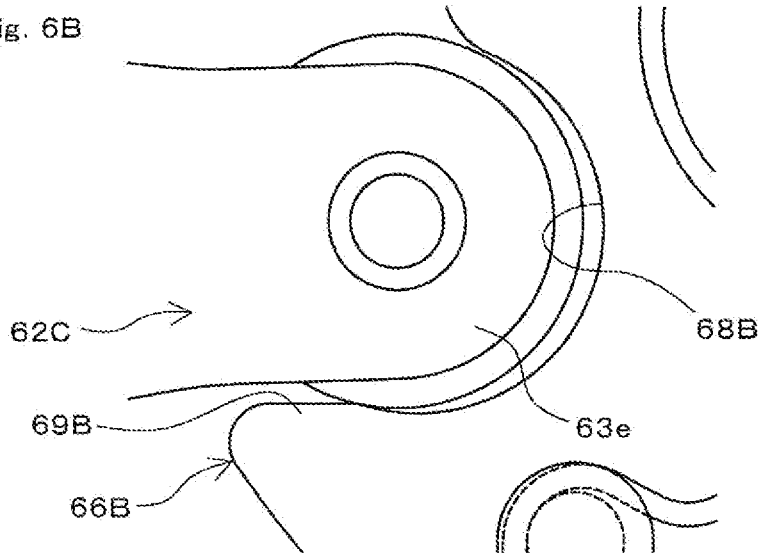
FIG. 6B is an enlarged view of a portion VIB in FIG. 5.

In the state shown in FIG. 5, if forces in the opening directions $A_{OPN}$ and $B_{OPN}$ are exerted respectively on the lock pins 14A and 14B, the pivoting of the engaging members 66A and 66B respectively in the directions F1 and F2 is restricted in the following manner. Specifically, both end portions of the link mechanism 61 in the linear state (end portions of the links 62*b* and 62*c* in the opening directions $A_{OPN}$ and $B_{OPN}$) are held while being sandwiched by peripheral portions of the opening portions of the second engaging portions 68A and 68B. In particular, the aforementioned bulging portion 69A is formed at the portion (near an area G in FIG. 6A) to which the rotational force is transmitted from the link 62*b* to the second engaging portion 68A when the engaging member 66A is about to rotate in the direction F1. This configuration makes it hard for the link 62*b* to withdraw from the second engaging portion 68A. Accordingly, the movement of the lock pins 14A and 14B engaging respectively with the engaging members 66A and 66B in the opening directions $A_{OPN}$ and $B_{OPN}$ is restricted by the first engaging portions 67A and 67B.

The door opening and closing apparatus 2 also includes a door lock detection switch 51 and a door close detection switch 52.

The door lock detection switch 51 is provided in order to detect whether or not the locking by the lock mechanism 60 has been completed, and is fixed to the base 5. The door lock detection switch 51 is configured to be switched between an on state and an off state by a permanent magnet (not shown)

fixed to the carrier 23. That is to say, the door lock detection switch 51 attached to the base 5 is configured to be switched by the permanent magnet moving with rotation of the carrier 23.

The door close detection switch 52 is provided in order to detect whether or not the sliding doors 11A and 11B are at the fully closed position, and is disposed above the sliding doors 11A and 11B and between the left and right sliding doors 11A and 11B. For example, the door close detection switch 52 is configured, for example, to be brought into an on state when the sliding doors 11A and 11B are at the fully closed position, and to be brought into an off state when the sliding doors 11A and 11B are at the opened position.

The door lock detection switch 51 is in the off state at the position of the carrier 23 when the sliding doors 11A and 11B are operating with normal movement resistance. At this time, the carrier 23 is at a position where the traction member 70 is caused to come into contact with the attachment portion 33*a*. On the other hand, when the output shaft 90*a* of the electric motor 90 further rotates in a state where the movement of the sliding doors 11A and 11B is stopped, the sun gear 21 rotates the planetary gears 24, and consequently the carrier 23 can rotate. Upon the carrier 23 rotating by a predetermined amount, the position of the permanent magnet is displaced, and the door lock detection switch 51 is thereby brought into the on state.

Figure 7:
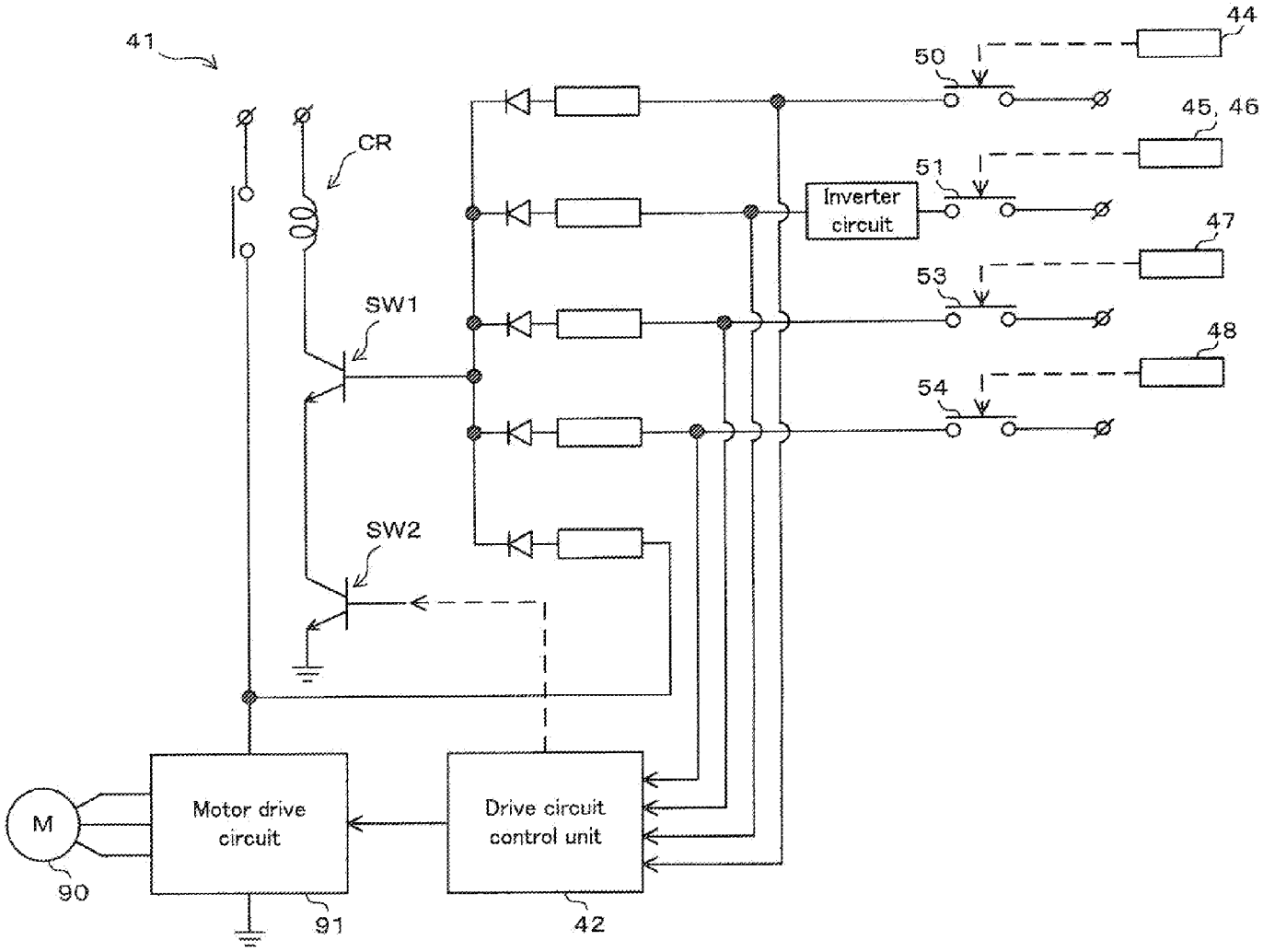
FIG. 7 is a circuit diagram showing a configuration of a control unit.

FIG. 7 is a circuit diagram showing a configuration of the control unit 41. The control unit 41 includes a motor drive circuit 91 (actuator drive circuit) for driving the motor, a drive circuit control unit 42 that controls the motor drive circuit 91, a relay CR (power supply control unit) that controls power supply to the motor drive circuit 91, a plurality of switches, and the like. The control unit 41 controls switching between an on state and an off state of the driving of the electric motor 90, the rotational direction of the output shaft 90*a* of the electric motor 90, and the driving force of the electric motor 90, for example.

The motor drive circuit 91 has a plurality of switching elements (not shown), and drives the motor 90 by the switching elements performing a switching operation. The drive circuit control unit 42 drives the motor 90 by appropriately performing the switching of the switching elements of the motor drive circuit 91.

As shown in FIG. 7, the relay CR is brought into an on state when both switches SW1 and SW2 are brought into an on state. At this time, electric power is supplied to the motor drive circuit 91.

The switch SW1 is brought into the on state if any of the following four conditions is satisfied. Specifically, the switch SW1 is brought into the on state if (1) a switch 50 is turned on upon receiving a vehicle-outside release signal (release command) transmitted as a result of a vehicle-outside release button 44, which is provided outside the vehicle, being subjected to a turning-on operation. Also, the switch SW1 is brought into the on state if (2) the door lock detection switch 51 is switched from the on state to the off state as a result of the sliding doors 11A and 11B being mechanically unlocked by any of unlocking handles 45 and 46, which are mounted inside and outside the vehicle, respectively. Also, the switch SW1 is brought into the on state if (3) a switch 53 is turned on upon receiving an opening permission signal transmitted as a result of an opening permission button 47 being operated by a crew member when passengers board and exit the vehicle. Also, the switch SW1 is brought into the on state if (4) a switch 54 is turned on upon receiving a simultaneous opening signal (unlocking command) transmitted as a result of a simultaneous opening button 48 being subjected to a turning-on operation at the time of emergency.

The switch SW2 is brought into the on state when the drive circuit control unit 42 is performing driving.

Description of Operations of Each Part when in Unlocked State

FIG. 4 shows the lock mechanism 60 in the unlocked state. In this unlocked state, the link mechanism 61 is in the bent state.

Referring to FIGS. 2 and 4, when the sun gear 21 in the planetary gear mechanism 20 is driven by the electric motor 90 when in the unlocked state, the driving force that is input to the sun gear 21 is transmitted as described below. Specifically, the driving force that is input to the sun gear 21 is transmitted to the pinion 9 via the internal gear 22, or revolves the planetary gear 24 and rotates the carrier 23. In the case where the carrier 23 is rotated, the traction member 70 is displaced in the locking direction C, and the torque limiter spring 71 is elastically compressed.

Here, the torque limiter spring 71 exerts a predetermined elastic force on the carrier 23 via the traction member 70. The predetermined elastic force refers to an elastic force that can suppress the rotation of the carrier 23 with the revolution of the planetary gears 24 when the sliding doors 11A and 11B are moving from the opened position toward the fully closed position.

As a result of the rotation of the carrier 23 being restricted by the torque limiter spring 71 using the predetermined elastic force, the planetary gears 24 do not revolve but rotate with rotation of the sun gear 21 in the planetary gear mechanism 20 during a normal closing operation. The driving force of the sun gear 21 is thereby transmitted to the pinion 9 via the internal gear 22, displaces the racks 7A and 7B respectively in the closing directions $A_{CLS}$ and $B_{CLS}$ or the opening directions $A_{OPN}$ and $B_{OPN}$, and the sliding doors 11A and 11B are driven to open or close.

Description of Mechanical Operations During Operation of Closing Sliding Doors

Next, a description will be given of a closing operation, which is an operation of moving the sliding doors 11A and 11B from the fully opened position to the fully closed position, and then locking the sliding doors 11A and 11B by the lock mechanism 60. First, in order to move the sliding doors 11A and 11B from the fully opened position to the fully closed position, the output shaft 90*a* of the electric motor 90 is rotated in one direction. Thus, the driving force of the electric motor 90 is transmitted to the sun gear 21, the planetary gears 24, and the internal gear 22 in this order, and the internal gear 22 rotates the pinion 9. The racks 7A and 7B, the racks 7A and 7B and the sliding doors 11A and 11B thereby move in the closing directions $A_{CLS}$ and $B_{CLS}$, respectively. At this time, the rotation of the carrier 23 is restricted by the biasing force of the torque limiter spring 71.

Upon the sliding doors 11A and 11B moving respectively in the closing directions $A_{CLS}$ and $B_{CLS}$ from the state shown in FIG. 4, the lock pins 14A and 14B pivot the engaging members 66A and 66B around the pivoting shafts 81A and 81B in the rotational directions E1 and E2 against the elastic restoring forces of the return springs 74A and 74B, respectively. Thus, the lock pins 14A and 14B move respectively into the first engaging portions 67A and 67B, as shown in FIG. 5.

At this time, the lock pins 14A and 14B have reached the fully closed position together with the sliding doors 11A and 11B. The first engaging portions 67A and 67B are disposed so as to surround the lock pins 14A and 14B and engage with the lock pins 14A and 14B, respectively, and the second engaging portions 68A and 68B engage with the respective end portions of the link mechanism 61 that is in the linear state. At this time, both end portions of the link mechanism 61 in the linear state are held while being sandwiched by the peripheral portions of the opening portions of the second engaging portions 68A and 68B. In particular, the aforementioned bulging portion 69A is formed at the portion (near the area G in FIG. 6A) to which the rotational force is transmitted from the link 62*b* to the second engaging portion 68A when the engaging member 66A is about to rotate in the direction F1 due to the biasing force of the return spring 74A. This configuration makes it hard for the link 62*b* to withdraw from the second engaging portion 68A. Accordingly, the movement of the lock pins 14A and 14B engaging with the engaging members 66A and 66B in the opening directions $A_{OPN}$ and $B_{OPN}$ is restricted by the first engaging portions 67A and 67B, respectively. That is to say, the sliding doors 11A and 11B are locked.

As described above, the lock mechanism 60 operates using the output of the electric motor 90 after the sliding doors 11A and 11B move to the fully closed position using the output of the electric motor 90, and the sliding doors 11A and 11B are thereby locked. Accordingly, the locking of the sliding doors 11A and 11B that is linked to the closing thereof is realized only by driving the sun gear 21 in the planetary gear mechanism 20 using the single electric motor 90.

Description of Mechanical Operations During Opening Operation

Next, a description will be given of an operation of unlocking the sliding doors 11A and 11B that have been locked by the lock mechanism 60 and then moving the sliding doors 11A and 11B from the fully closed position to the fully opened position, that is, an opening operation.

Note that the opening operation is achieved simply by rotating the output shaft 90*a* of the electric motor 90 in the other direction, which is opposite to the aforementioned one direction during the opening operation. Specifically, the output shaft 90*a* of the electric motor 90 is rotated in the other direction when in the locked state shown in FIG. 5. The carrier 23 thereby rotates in a clockwise direction in FIG. 2, and displaces the traction member 70 and the lock slider 33 in the unlocking direction D against the biasing force of the lock spring 73.

At this time, the projecting shaft 33*e* of the lock slider 33 moves in the unlocking direction D, and with this movement, the link 62*a* in the link mechanism 61 rotates around the pin 63*a*. The link mechanism 61 thereby transitions from the linear state to the bent state shown in FIG. 4. Thus, the pins 63*d* and 63*e* located at the respective end portions of the link mechanism 61 are disengaged from the second engaging portions 68A and 68B of the engaging members 66A and 66B, respectively. For this reason, a rotational displacement of the engaging members 66A and 66B is allowed, and the sliding doors 11A and 11B are unlocked. At this time, the engaging members 66A and 66B receive, due to the elastic restoring forces of the return springs 74A and 74B, the biasing forces that pivot the engaging members 66A and 66B around the pivoting shafts 81A and 81B in the rotational directions F1 and F2, respectively. That is to say, the return springs 74A and 74B bias the engaging members 66A and 66B in the directions F1 and F2 so as to support the unlocking of the sliding doors 11A and 11B by the lock mechanism 60.

When the rotation amount of the carrier 23 reaches a predetermined amount, the movement of the lock slider 33 in the unlocking direction D is constrained due to a deformation limit of the lock spring 73, for example. Note that the movement of the lock slider 33 in the unlocking direction D may be restricted not by the lock spring 73 compressed up to the deformation limit thereof, but alternatively by the carrier 23 and the plate member 5*a* that come into contact with each other at a predetermined position. This movement restriction may be performed by the movement of the pins 63*d* and 63*e* in the link mechanism 61 being constrained by the guide grooves 80A and 80B as a result of appropriately setting the length of the guide grooves 80A and 80B into which the pins 63*d* and 63*e* are inserted, respectively. In this case, the movement of the lock slider 33 is constrained by constraining the deformation of the link mechanism 61.

Referring to FIG. 2, as a result of the restriction on the movement of the lock slider 33 in the unlocking direction D, the driving force of the sun gear 21 is then transmitted to the internal gear 22 side. The sliding doors 11A and 11B are thereby displaced respectively in the opening directions $A_{OPN}$ and $B_{OPN}$ together with the racks 7A and 7B in the rack-and-pinion mechanism 10, and the sliding doors 11A and 11B are displaced toward the respective fully opened position.

Figure 8:
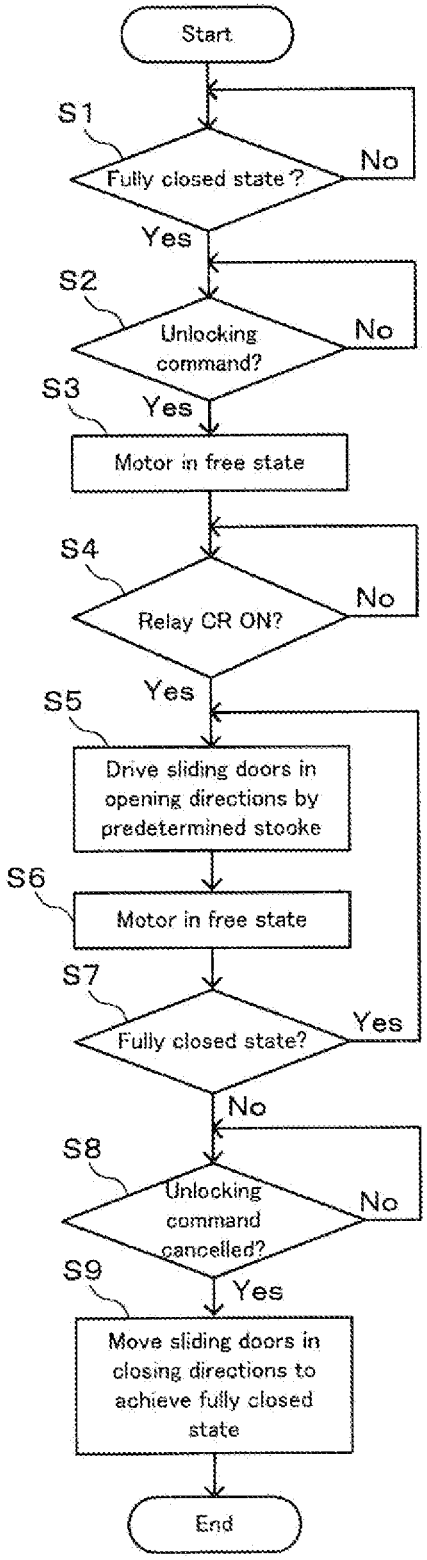
FIG. 8 is a flowchart for illustrating operations of the door opening and closing apparatus after a command to unlock sliding doors is given.

Operations of Door Opening and Closing Apparatus after Door Unlocking Command is Given FIG. 8 is a flowchart for illustrating operations of the door opening and closing apparatus after a command to unlock the sliding doors 11A and 11B is given.

In a state where the sliding doors 11A and 11B are in the fully closed state (Yes in step S1), if the vehicle-outside release button 44 is subjected to a turning-on operation or the simultaneous opening button 48 is subjected to a turning-on operation such that the vehicle-outside release signal (unlocking command) or the simultaneous opening signal (unlocking command) is transmitted (Yes in step S2), the door opening and closing apparatus 2 brings the motor 90 into a free state (step S3).

In the case where the motor drive circuit 91 is normally controlled by the drive circuit control unit 42 in a state where the release command has been transmitted in step S2 as mentioned above (i.e., in the case where the motor 90 is not out of control), the relay CR is brought into the on state (Yes in step S4). At this time, the drive circuit control unit 42 controls the motor 90 and opens the sliding doors 11A and 11B by a predetermined stroke (step S5), and thereafter again brings the motor 90 into the free state (step S6).

Thereafter, in a state where the sliding doors 11A and 11B are not in the fully closed state (No in step S7), upon the unlocking command being cancelled (Yes in step S8), the motor drive circuit 91 drives the motor 90 at a low speed and moves the sliding doors 11A and 11B in the closing directions so as to bring the sliding doors 11A and 11B into the fully closed state (step S9).

On the other hand, if the sliding doors 11A and 11B are brought into the fully closed state before the release command is cancelled (Yes in step S7), the drive circuit control unit 42 controls the motor 90 and opens the sliding doors 11A and 11B by a predetermined stroke (step S5), and thereafter brings the motor 90 into the free state (step S6).

Effects

As described above, with the door opening and closing apparatus 2 according to the present embodiment, the sliding doors 11A and 11B are locked by the lock mechanism 60 such that the sliding doors 11A and 11B do not move in the opening directions $A_{OPN}$ and $B_{OPN}$, respectively, when the sliding doors 11A and 11B are in the fully closed state. Thus, the movement of the sliding doors 11A and 11B in the opening directions $A_{OPN}$ and $B_{OPN}$ can be mechanically prevented by the lock mechanism 60 even if the motor 90 is brought into the free state due to a malfunction or the like. That is to say, the fail-safe capability of the door opening and closing apparatus 2 can be improved.

With the door opening and closing apparatus 2, upon the drive circuit control unit 42 receiving an unlocking command at the time of emergency, the sliding doors 11A and 11B move respectively in the opening directions $A_{OPN}$ and $B_{OPN}$, and the sliding doors 11A and 11B can then be manually opened and closed. Consequently, a crew member or a passenger can freely open and close the sliding doors 11A and 11B at the time of emergency.

With the door opening and closing apparatus 2, even if the sliding doors 11A and 11B are closed to achieve the fully closed state and the lock mechanism 60 is brought into the locked state in a state where the sliding doors 11A and 11B can be manually opened and closed as mentioned above, the lock mechanism 60 is switched to the unlocked state and the sliding doors 11A and 11B again move respectively in the opening directions $A_{OPN}$ and $B_{OPN}$ until the unlocking command is cancelled. It is thereby possible to prevent the locked state of the sliding doors 11A and 11B from being maintained in a state where the unlocking command has not been cancelled.

Accordingly, with the door opening and closing apparatus 2, it is possible to prevent the locked state of the sliding doors 11A and 11B from being maintained unintentionally.

With the door opening and closing apparatus 2, it is also possible to prevent the sliding doors 11A and 11B from being brought into the opened state as a result of the motor drive circuit 91 going out of control and driving the motor 90 in a state where the unlocking command has not been given. That is to say, the fail-safe capability of the door opening and closing apparatus 2 can be further improved.

With the door opening and closing apparatus 2, the drive circuit control unit 42 drives the motor drive circuit 91 to which electric power is supplied under a condition that the lock mechanism 60 is mechanically operated based on a manual operation, such that the sliding doors 11A and 11B move in the respective opening directions. Thus, after the lock mechanism 60 is unlocked by a manual operation, manual movement of the sliding doors 11A and 11B in the opening directions $A_{OPN}$ and $B_{OPN}$ can be assisted using the driving force of the motor 90.

With the door opening and closing apparatus 2, it is also possible to prevent the sliding doors 11A and 11B from being brought into the opened state as a result of the motor drive circuit 91 going out of control and driving the motor 90 in a state where the drive circuit control unit 42 does not perform driving. That is to say, the fail-safe capability of the door opening and closing apparatus 2 can be still further improved.

With the door opening and closing apparatus 2, the end portions of the link mechanism 61 inserted into the opening portions of the engaging members 66A and 66B can be prevented from withdrawing from the opening portions by the bulging portion 69A. The lock mechanism 60 can thereby be reliably held in the locked state.

With the door opening and closing apparatus 2, the end portion of the link mechanism 61 inserted into the opening portion of the engaging member 66A can be appropriately prevented from withdrawing from the opening portion by the bulging portion 69A.

With the door opening and closing apparatus 2, the return springs 74A and 74B are provided in association with the engaging members 66A and 66B in one-to-one correspondence. For example, in the case where only one return spring is provided, if this return spring is broken or withdraws, the engaging members 66A and 66B cannot be appropriately rotated in the unlocking directions (directions F1 and F2). In contrast, with the door opening and closing apparatus 2, even if one of the two return springs 74A and 74B is broken or withdraws, the other of the return springs 74A and 74B can appropriately rotate the engaging members 66A and 66B in the respective unlocking directions. That is to say, with the door opening and closing apparatus 2, the lock mechanism 60 can be operated more appropriately.

With the door opening and closing apparatus 2, the engaging members 66A and 66B can be appropriately biased by the return springs 74A and 74B that are constituted by torsion springs.

Furthermore, with the door opening and closing apparatus 2, both end portions of the link mechanism 61 in the lock mechanism 60 in the locked state can be more reliably prevented from withdrawing from the opening portions of the engaging members 66A and 66B. That is to say, the locked state of the lock mechanism 60 can be held more reliably.

In the door opening and closing apparatus 2, the first face 75 and the second face 76 that are pressed by the projecting shaft 33*e* are provided so as to have a positional relationship in which the first face 75 and the second face 76 intersect each other. With this configuration, the interval between the first face 75 and the second face 76 can be widened. Thus, when the lock mechanism 60 is assembled, the projecting shaft 33*e* can be disposed between the first face 75 and the second face 76 with relative ease. Accordingly, with the door opening and closing apparatus 2, it is possible to provide a door opening and closing apparatus including a lock mechanism 60 whose required assembly accuracy and position accuracy are not as high as those in the conventional technique.

With the door opening and closing apparatus 2, since the projecting shaft 33*e* moves along the second face 76 of the link mechanism 61 in the linear state, the link mechanism 61 can be reliably changed from the bent state to the linear state even if the moving amount of the projecting shaft 33*e* varies. For this reason, the required assembly accuracy and position accuracy are not as high as those in the conventional technique, and therefore the workability in assembly can be further improved.

With the door opening and closing apparatus 2, since the position of the link 62*a* is reliably fixed by the projecting shaft 33*e* and the rotation restricting member 83, the linear state or the bent state of the link mechanism 61 can be maintained even if the connection between the link 62*a* and the links 62*b* and 62*c* is more or less loose. Consequently, the required assembly accuracy and position accuracy of the link mechanism 61 are not as high as those in the conventional technique, and therefore the workability in assembly can be still further improved.

Although an embodiment of the present invention has been described above, the present invention is not limited to the above embodiment, and various modifications may be implemented within the scope recited in the claims. For example, the following modifications may be implemented.

(1) In the above embodiment, the return springs 74A and 74B are provided that bias the engaging members such that the link mechanism engaging with the engaging members is held in the linear state. However, this need not be the case. For example, as a biasing portion corresponding to the return springs 74A and 74B, a biasing portion may be provided that biases the link mechanism such that the link mechanism is held in the linear state. With this configuration as well, as in the above embodiment, a lock mechanism can be configured that can be appropriately switched between the locked state and the unlocked state.

(2) In the above embodiment, both the first face 75 and the second face 76 are formed in the link 62*a* serving as a second link member. However, this need not be the case. Specifically, for example, one of the first face 75 and the second face 76 may be formed in the links 62*b* and 62*c* each serving as the first link member, or both the first face 75 and the second face 76 may be formed in the links 62*b* and 62*c*.

The present invention can be widely applied to door opening and closing apparatuses that open and close a sliding door of a vehicle such as a railway vehicle. The present invention is not limited to the above embodiment, and all modifications, applications, and equivalents thereof that fall within the claims, for which modifications and applications would become naturally apparent by reading and understanding the present specification, are intended to be embraced in the claims.

What is claimed is:

1. A door opening and closing apparatus for opening and closing a door, comprising:

an actuator that moves the door in an opening direction and a closing direction; and a lock mechanism that holds the door in a fully closed state, and has an engaging member which engages with a lock member provided in the door when in the fully closed state, and a link mechanism which has a plurality of link members, is configured to switch between a first state and a second state, and restricts rotation of the engaging member by being brought into the first state, wherein the link mechanism has a first face that is formed in one of the link members and is pressed by a projecting shaft moved by the actuator in order that the link mechanism changes from the first state to the second state, and a second face that is formed in one of the link members and is pressed by the projecting shaft in order that the link mechanism changes from the second state to the first state, and the first face and the second face form an L-shaped face, and are provided so as to have a positional relationship in which the first face and the second face of the L-shaped face intersect each other.

2. The door opening and closing apparatus according to claim 1, wherein the second face is a face that is aligned with a moving direction of the projecting shaft when the link mechanism is in the first state.

3. The door opening and closing apparatus according to claim 2, wherein the engaging member has an engaging portion in which an opening portion is formed, an end portion of the link mechanism being inserted into the opening portion when the engaging member is rotated in a predetermined direction by the lock member moving in the closing direction, the link members include a first link member having an end portion that serves as the end portion of the link mechanism and is inserted into the opening portion, and a second link member that is connected to the first link member and is provided rotatably, and a rotation restricting member that restricts rotation of the second link member is further provided.

4. The door opening and closing apparatus according to claim 3, wherein a withdrawal preventing portion that prevents the end portion of the link mechanism engaging with the opening portion from withdrawing in a case where a force in the opening direction is exerted on the door in the fully closed state is formed in the opening portion.

5. The door opening and closing apparatus according to claim 4, wherein the withdrawal preventing portion has a bulging portion that is formed in a part of the opening portion on a side opposite to a side in the predetermined direction, and that bulges from the part toward the opening portion.

6. The door opening and closing apparatus according to claim 1, wherein the lock mechanism includes:

a plurality of the engaging members each being rotated in a predetermined direction by the lock member moving in the closing direction; and a plurality of biasing portions that are provided in association with the engaging members in one-to-one correspondence and bias the respective engaging members in a direction opposite to the predetermined direction.

* * * * *